United States Patent [19]

Toof

[11] 4,080,866

[45] Mar. 28, 1978

[54] LIGATURE MEANS AND A METHOD OF SECURING A REED IN A WIND INSTRUMENT

[76] Inventor: Milo Rockwood Toof, Main St., Franklin, Vt. 05457

[21] Appl. No.: 727,477

[22] Filed: Sep. 28, 1976

[51] Int. Cl.[2] ..... G10D 9/02

[52] U.S. Cl. ..... 84/383 R

[58] Field of Search ..... 84/383 R

[56] References Cited

U.S. PATENT DOCUMENTS

| | | | |
|---|---|---|---|
| 1,575,621 | 3/1926 | Chiron et al. | 84/383 R |
| 2,292,584 | 8/1942 | Tafarella | 84/383 R |
| 3,410,170 | 11/1968 | Gigliotti | 84/383 R |

FOREIGN PATENT DOCUMENTS

| | | | |
|---|---|---|---|
| 626,478 | 7/1949 | United Kingdom | 84/383 R |

*Primary Examiner*—Lawrence R. Franklin

*Attorney, Agent, or Firm*—Thomas N. Neiman

[57] ABSTRACT

The ligature means, according to an embodiment thereof, comprises a device defining an improved ligature having bars fixed therewith so that the bars alone will contact the reed only along the longitudinal or elongate centerline of the reed. The method comprises the disposition of the reed in optimum positioning on the mouthpiece of a wind instrument, and securing it in position by applying a clamping pressure thereto only on the elongate or longitudinal centerline thereof.

6 Claims, 6 Drawing Figures

LIGATURE MEANS AND A METHOD OF SECURING A REED IN A WIND INSTRUMENT

This invention pertains to musical, wind instrument mouthpieces, such as clarinet or saxophone mouthpieces and the like and in particular to means for more effectively holding the reed down flat on the mouthpiece with practically no restriction. The normal ligature tends to pin the reed too restrictively against the mouthpiece. Prior art is exemplified by U.S. Pat. No. 3,890,873 issued to Robert L. Harrison, for a Ligature on June 24, 1976 and by U.S. Pat. No. 2,791,929 issued to Daniel Bonade, on May 14, 1957, for Ligatures for Clarinets or the Like. In addition, the U.S. Pat. No. 2,648,246 issued on Aug. 11, 1953 to Walter W. Mueller, for a Ligature for Musical Instruments is illustrative of devices which are added to standard ligatures to improve their reed holding characteristics. Harrison's device is a web like unit formed by a pair of back to back U-shaped members which contact the reed at its outer edges. The unit described by Bonade contains two long strips equal in length to the ligature itself. In this case, the reed is contacted along the entire length of the ligature. Mueller's pressure equalizing plate holds the reed fully across the width. What has been needed is a device and method for effectively holding the reed in place which will allow the instrument to be played and yet will allow the reed as much vibration as is possible to permit maximum versatility of the instrument. Especially what is needed is an efficient, simple to manufacture unit which will provide richer tonal qualities to the instrument, and a method for securing a reed in a wind instrument which will yield the aforesaid benefits.

It is the object of this invention to provide an improved ligature means to most effectively allow the utmost vibration of the reed while at the same time holding the reed against the mouthpiece with no slippage.

It is also an object of this invention to teach a ligature means, for use with a reed instrument, for holding an elongate reed on the mouthpiece of of the instrument, comprising a circular housing means, of split ring construction, for securing a reed on the mouthpiece; said housing means having clamping means for compressively clamping said housing onto said mouthpiece; and wherein said housing means comprises means for contacting said reed only on the elongate centerline of said reed.

Another object of this invention is to set forth ligature means, for use with a reed instrument, for holding an elongate reed on the mouthpiece of the instrument, comprising a ligature; and means carried by said ligature for compressively engaging a reed only on the elongate centerline of said reed.

Yet another object of this invention is to teach a method of securing an elongate reed, having arcuate and flat opposed surfaces, on a mouthpiece of a musical wind instrument, comprising the steps of disposing the reed in position on the mouthpiece, with the flat surface of the reed in engagement with a surface of the mouthpiece, and with the arcuate surface outwardly exposed; and clamping the reed in position on said mouthpiece surface by applying clamping pressure to the reed only on the elongate centerline of the outwardly exposed arcuate surface thereof.

Further objects of this invention, as well as the novel features thereof, will become apparent when one studies the following description of the embodiments of the invention, taken in conjunction with accompanying figures, in which.

Figure 1:
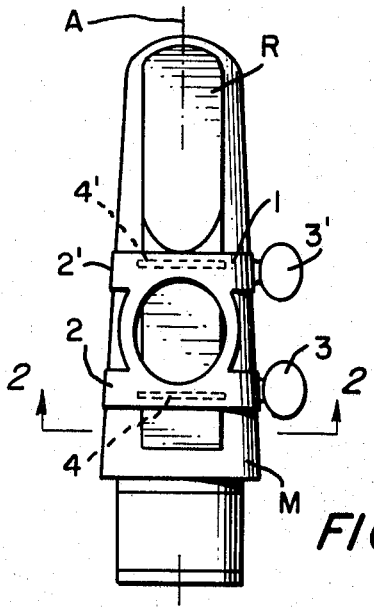
FIG. 1 is a plan or top view of a preferred embodiment of the ligature means.

As shown in FIG. 1, the ligature means, according to the preferred embodiment thereof, comprises a ligature 1, formed by a pair of split rings 2 and 2', which are tightened onto the mouthpiece M by means of wing screws 3 and 3'. As these wing screws 3 and 3' are tightened, the split rings 2 and 2' compress as to bring the rings 2 and 2' in contact with the reed R, which in turn secures the reed R against the mouthpiece M. This is the standard or prior art arrangement, by means of which the arcuate configuration of the rings 2 and 2' close upon the arcuate, exposed, upper surface of the reed R and hold the reed R fast, fully across the width thereof, onto the mouthpiece M. Unfortunately, in so securely clamping the reed R onto the mouthpiece, the full free vibration of the reed is unduly damped or suppressed. Ideally, the reed R needs only to be held fast to the mouthpiece, and the more it is unrestrained, that it might vibrate, the more responsive will be the musical instrument. In this embodiment, then, I disclose means for securing the reed R to the mouthpiece M, with all possible vibratory freedom, by interposing between the rings 2 and 2' and the reed R a pair of rigid, linear bars 4 and 4'. Bars 4 and 4' are rigid, of course, in order that they will make point contacts with the reed R only on centerline A thereof, and hold the reed R fast to the mouthpiece M in fixed or clamped engagement thereat, i.e., on the centerline, as it is my purpose to leave lateral portions of the reed (to each side of the centerline A) free to vibrate. The unit 1 is constructed of metal and the bars 4 and 4' can either be soldered or stamped into the ligature 1 and may be of varying widths, although in the depicted embodiment they are equal.

Figure 2:
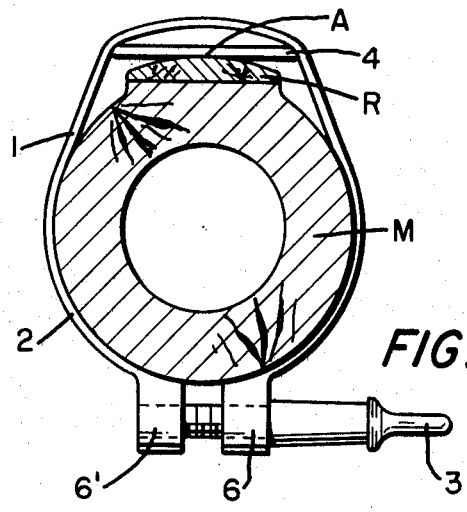
FIG. 2 is an enlarged cross-sectional view, taken along 2—2 of FIG. 1, to show a different aspect of the preferred embodiment.

FIG. 2 is a view of the ligature 1 taken from the wider end of the mouthpiece M. As previously discussed, the split ring 2 is compressed by turning the wing screw 3 which turns through the bored eye-holes 6 and 6'. This action draws the bars 4 and 4' against the reed R. It should be noted that the bars 4 and 4' must be long enough so that the sides of the ligature 1 will not touch the reed R and that the reed R is held against the mouthpiece M by the bars 4 and 4' only along the longitudinal axis A of the reed R. This insures that the reed R is being held against the mouthpiece M by the bars 4 and 4' at only two points. The wing screws 3 and 3' may be individually tightened to personal preference.

Figure 3:
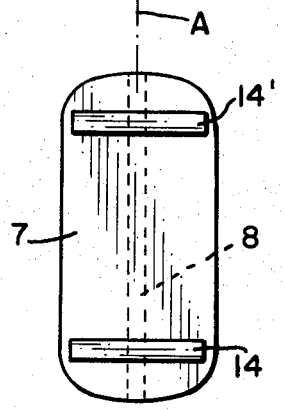
FIG. 3 is the bottom view of a novel adapter, to be used as an addition to the standard ligature, according to an alternative embodiment of the invention.
Figure 4:
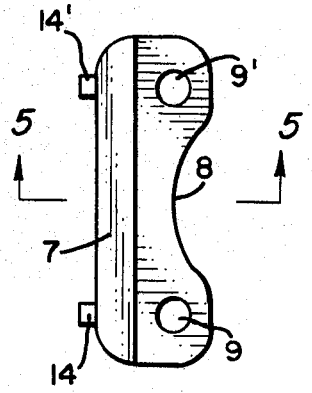
FIG. 4 is a side view, taken from the right side of FIG. 3 of the ligature adapter.
Figure 5:
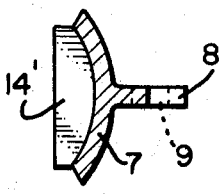
FIG. 5 is a cross-sectional view of the adapter, taken along section 5—5 of FIG. 4.
Figure 6:
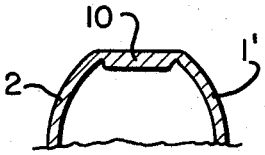
FIG. 6 is a cross-sectional view taken transverse of a ligature, according to an additional embodiment of the invention, the view being only a fragment of a cross-section of a ring of the ligature.

FIG. 3 is the bottom view of an alternate embodiment comprising an adapter which can be added to a standard ligature. As shown, the adapter comprises bars 14 and 14' which are stamped or soldered onto a plate 7. As shown in FIG. 4, which is the side view taken from the right side of FIG. 3, and FIG. 5, a cross-sectional view along 5—5 of FIG. 4, there is an extension 8 from the plate 7 which has a number of fastener openings 9 and 9'. These openings are designed to receive the wing screws 3 and 3' and, thus, the adapter can be fitted into a standard ligature and tightened in position. In this embodiment, the tightening wing screws 3 and 3' would be disposed on the top end of the mouthpiece M, to cause the bars 14 and 14' to engage the reed R. As can be appreciated, the invention comprehends a method of securing a reed R onto a mouthpiece M, by clamping the reed R in position on the mouthpiece M by applying the necessary clamping pressure to the reed R only on the elongate centerline A. Thus, except for where this pressure is applied, the remainder of the reed R is unrestrained. Many means of practicing this method will occur to others, by taking teaching from my disclosure. For example, and quite within the ambit of my invention, as an alternative practice of the method, a ligature 1' having split rings 2 and 2', may have the reed-engaging portions of the rings deformed to define thereof means for pressuring only the centerline A of the reed R. This is exemplified in FIG. 6, where a fragment of a ring 2 is shown in cross-section, the ring 2 having been flattened on the inner surface thereof to form a prominence 10.

Accordingly, while I have described my invention in connection with specific embodiments thereof, it is clearly to be understood that this is done only by way of example and not a limitation to the scope of my invention as set forth in the objects thereof and in the claims.

I claim:

1. A ligature for clamping a reed having arcuate and flat opposed surfaces to a woodwind instrument mouthpiece, comprising:

circular housing means, of split ring construction, for securing said reed on said mouthpiece;

clamping means for compressively clamping said housing onto said mouthpiece; and at least two rigid, linear bars located within said circular housing and extending transversely across said reed, each of said bars having a lower surface which contacts said reed arcuate surface substantially at a point on the longitudinal centerline of said reed, said bars being spaced from each other along said reed longitudinal centerline.

2. Ligature means, according to claim 1, wherein: said circular housing means has a plurality of diameters.

3. Ligature means, according to claim 1, wherein: said clamping means comprises at least one eyelet carried externally of said housing means in juxtaposition with at least another eyelet also carried externally of said housing, and means for engaging and drawing said eyelets together.

4. Ligature means according to claim 1 wherein a deformation of the inner surface of said circular housing constitutes each of said rigid bars.

5. Ligature means according to claim 1 wherein said rigid bars are formed on a separate element which is coupled to said circular housing.

6. Ligature means, according to claim 5, wherein: said element is elongate, and lies transverse of said ligature.

* * * * *